US006953309B1

(12) United States Patent
Tufts et al.

(10) Patent No.: US 6,953,309 B1
(45) Date of Patent: Oct. 11, 2005

(54) CONCRETE BLOCK WITH BATTER INDICATORS

(75) Inventors: Paul R. Tufts, Eagan, MN (US); Michael S. Lidbom, Big Lake, MN (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 0 days.

(21) Appl. No.: 10/896,776

(22) Filed: Jul. 13, 2004

(51) Int. Cl.[7] ..... E02D 29/02; E04C 1/00

(52) U.S. Cl. ..... 405/284; 405/286; 52/169.4; 52/590.2; 52/603; 52/604

(58) Field of Search ..... 405/284, 286, 405/287; 52/169.4, 561, 596, 590.2, 603–607

(56) References Cited

U.S. PATENT DOCUMENTS 2,371,201 A 3/1945 Wells
4,229,123 A * 10/1980 Heinzmann ..... 405/286
4,490,075 A 12/1984 Risi et al.
4,496,266 A 1/1985 Ruckstuhl
5,505,034 A * 4/1996 Dueck ..... 52/604
5,688,079 A 11/1997 Bolduc et al.
5,735,643 A 4/1998 Castonguay et al.
5,795,105 A 8/1998 Guth
5,827,015 A 10/1998 Woolford et al.
6,641,334 B2 * 11/2003 Woolford ..... 405/284

FOREIGN PATENT DOCUMENTS

CH 663437 * 12/1987 ..... 405/286
JP 03169907 * 7/1991 ..... 405/286

* cited by examiner

*Primary Examiner*—Jong-Suk (James) Lee
(74) *Attorney, Agent, or Firm*—Merchant & Gould P.C.

(57) ABSTRACT

A concrete retaining wall block provided with integral indicators that indicate the batter that will result from constructing a retaining wall of a multiplicity of the blocks. The indicators for indicating the batter are preferably one or more indentations formed in a surface of the block other than the front surface.

28 Claims, 5 Drawing Sheets

CONCRETE BLOCK WITH BATTER INDICATORS

FIELD OF THE INVENTION

The invention relates generally to concrete retaining wall blocks. More specifically, the invention relates to concrete retaining wall blocks that are provided with one or more indicators to indicate the degree of batter that will result from constructing a retaining wall of a multiplicity of the blocks that are dry stacked in ascending courses.

BACKGROUND OF THE INVENTION

Concrete blocks have been used for many years to construct retaining walls. In recent years, concrete retaining wall blocks are typically dry stacked in ascending courses without the use of mortar to secure the blocks to one another. These "segmental retaining walls" are typically built so that the face of the wall recedes from a vertical plane as the wall ascends. This receding slope of the wall is referred to as "batter".

Batter is typically specified in terms of degrees from vertical. The larger the batter, the less horizontal pressure that is applied by the soil behind the wall, and the center of gravity is further behind the wall. Both of these factors make the wall less likely to be pushed over by both the soil behind the wall and any hydrostatic pressure that builds up in the soil behind the wall. However, the larger the batter, the larger the amount of space the wall occupies laterally on the earth's surface, and, particularly in cities, that space is often limited.

It is possible to build a wall with batter by preparing the foundation of the wall at the desired angle, and then building up the successive courses with the bottom of the blocks parallel to the initially established angle. It is easier, and more typical, however, to build a perfectly level foundation and then to build up the successive courses so that each course is set back a uniform distance with respect to the course below.

To this end, modern concrete retaining wall blocks are provided with some form of "locator" mechanism that establishes the uniform setback and batter. The locator mechanism generally takes the form of a forward-facing locating surface and a rearward-facing locating surface. Each surface is typically formed on a single block, but, when a plurality of similar blocks are laid in successive courses, the forward-facing locating surfaces of the blocks in one course interact with the rearward-facing locating surfaces of an adjacent course to establish the setback. Examples of such a mechanism are the rear lip (flange) system shown in U.S. Pat. No. 5,827,015, the tongue and groove system shown in U.S. Pat. No. 4,490,075, and the inset wall system shown in U.S. Pat. No. 5,795,105.

In connection with any of the exemplified systems, and other similar systems, the setback and resulting batter of the wall are determined by the relative positions and/or dimensions of the locating surfaces. These relative positions/dimensions are fairly easy to adjust to the desired setback/batter, but must be established at the time of manufacture of the block. It is thus possible for a manufacturer to make a large inventory of blocks of one setback/batter, and to make a second inventory of nearly identical blocks of a second setback/batter. Without careful examination and measurement, it is not easy to tell the blocks that will make a wall with a seven degree batter from the blocks that will make a wall with a four degree batter.

Accordingly, there is a need for a simple means by which one can more readily determine by looking at a retaining wall block what the resulting batter will be from constructing a retaining wall of a multiplicity of the blocks.

SUMMARY OF THE INVENTION

The invention relates to providing a concrete retaining wall block with integral means for indicating the batter that will result from constructing a retaining wall of a multiplicity of the blocks.

The integral means for indicating the batter preferably comprises one or more indentations formed in a surface of the block other than the front surface. The indentation(s) can take a variety of forms, including a plurality of indentations each of which indicates a degree of batter that will result, or an indentation in the form of a numeral, for example a Roman numeral, with the numeral indicating the degree of batter. Any form and number of indentation(s) that serve to indicate the batter will suffice.

When the means for indicating the batter is in the form of one or more indentations on the top of the block, the indentations are preferably created by a stripper shoe which presses into the top of the block during formation of the block in a mold and which helps to strip the block from the mold.

Each block also includes a generally forward-facing locking surface and a generally rearward-facing locking surface. The locking surfaces are configured and positioned such that when a retaining wall is constructed of a multiplicity of the blocks in multiple courses, engagement between the forward-facing locking surface of a block in one course of blocks and the rearward-facing locking surface of a block in an adjacent course of blocks establishes the batter of the wall. In one disclosed embodiment, the generally rearward-facing locking surface is formed by an integral locator protrusion on the top of the block and the generally forward-facing locking surface is formed by an inset in the side of the block.

These and various other advantages and features of novelty are pointed out with particularity in the claims annexed hereto and forming a part hereof. However, for a better understanding of the invention, reference should be made to the drawings which form a further part hereof, and to the accompanying description, in which there is described a preferred embodiment utilizing the invention.

DETAILED DESCRIPTION OF THE INVENTION

An embodiment of a concrete block that utilizes integral means for indicating batter will be described in further detail below. The concepts described herein can be utilized on other types of concrete blocks as well.

Figure 1:
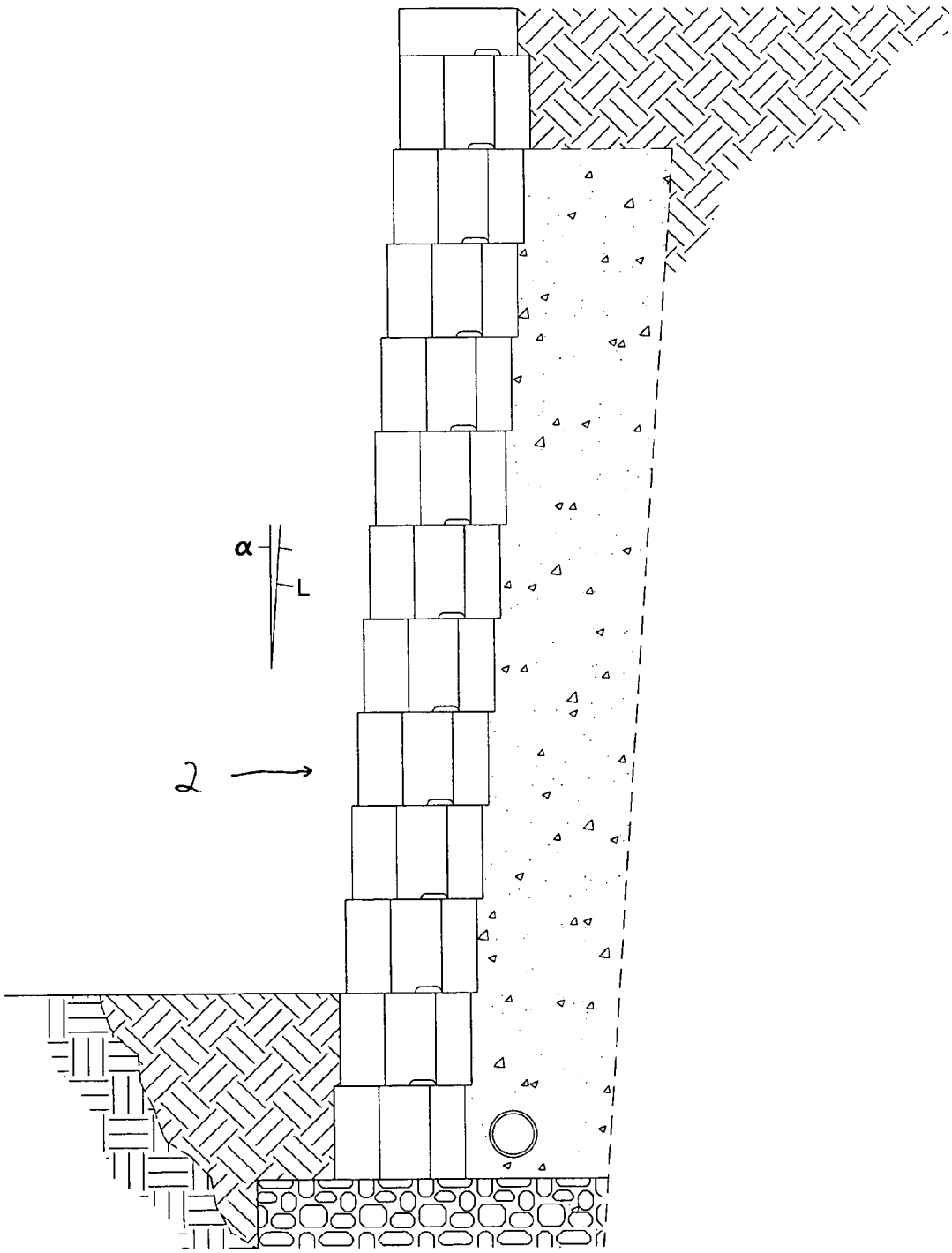
FIG. 1 is a view of a retaining wall illustrating setback courses and batter.

FIG. 1 illustrates a retaining wall 2 that comprises a plurality of courses of concrete blocks. The illustrated blocks are Vertica® style blocks available from Anchor Wall Systems, Inc. of Minnetonka, Minn. Each course of blocks is setback a distance from the course below so that an imaginary line, parallel to the line L in FIG. 1, interconnecting the top front edges of the blocks in each course is at an angle $\alpha$ relative to a vertical axis. The angle $\alpha$ is the batter of the wall 2.

Figure 2:
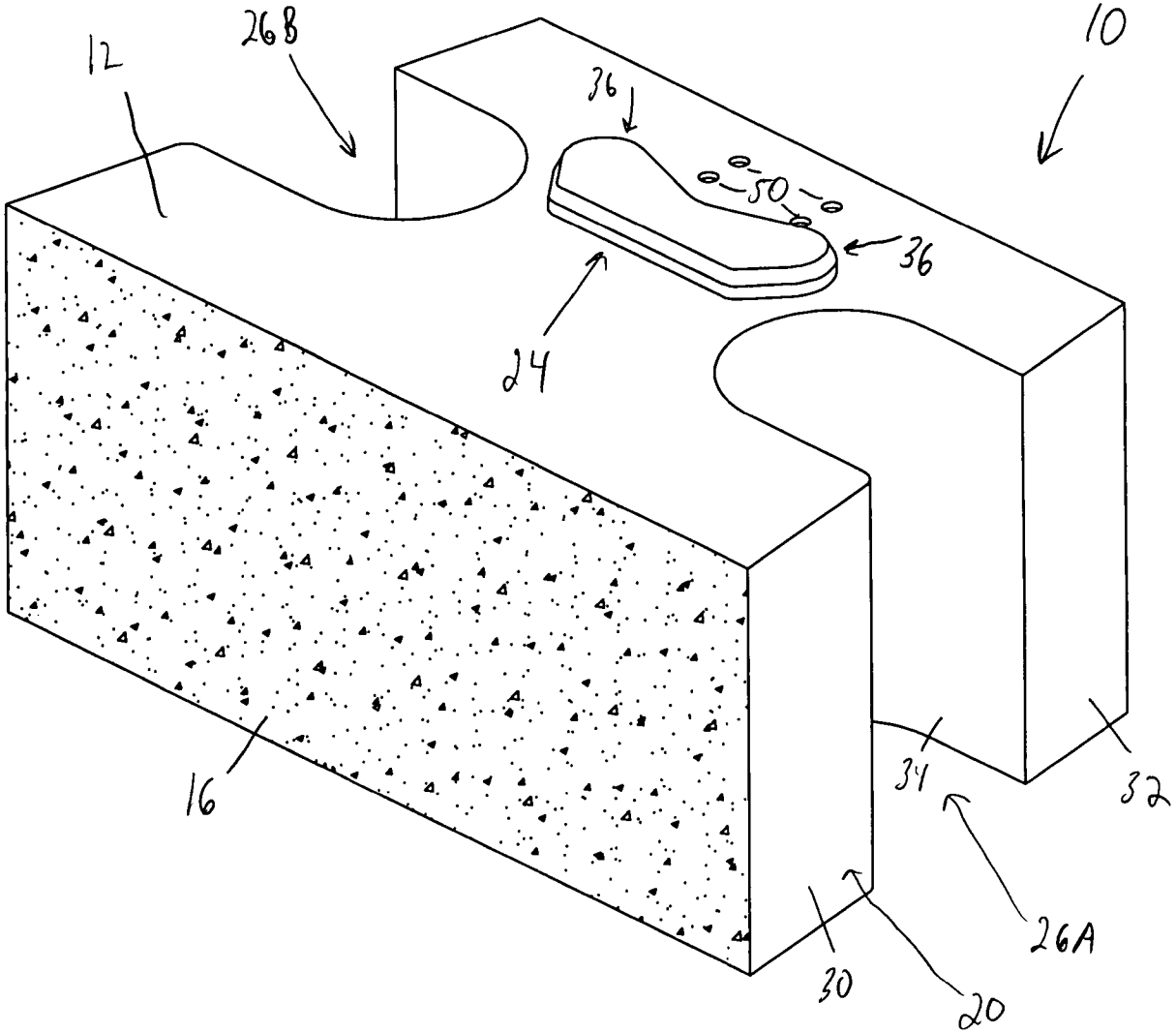
FIG. 2 is a perspective view of a retaining wall block having indentations on the top surface to indicate the degree of batter.
Figure 3:
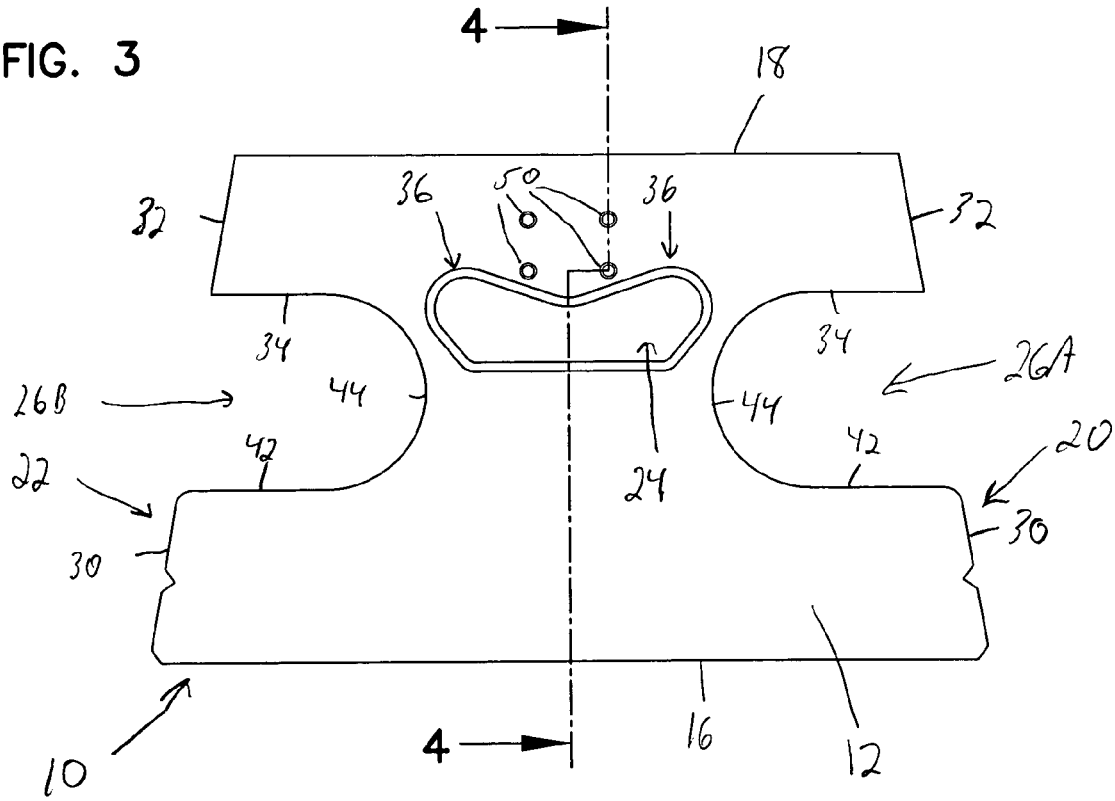
FIG. 3 is a top plan view of the block in FIG. 2.
Figure 4:
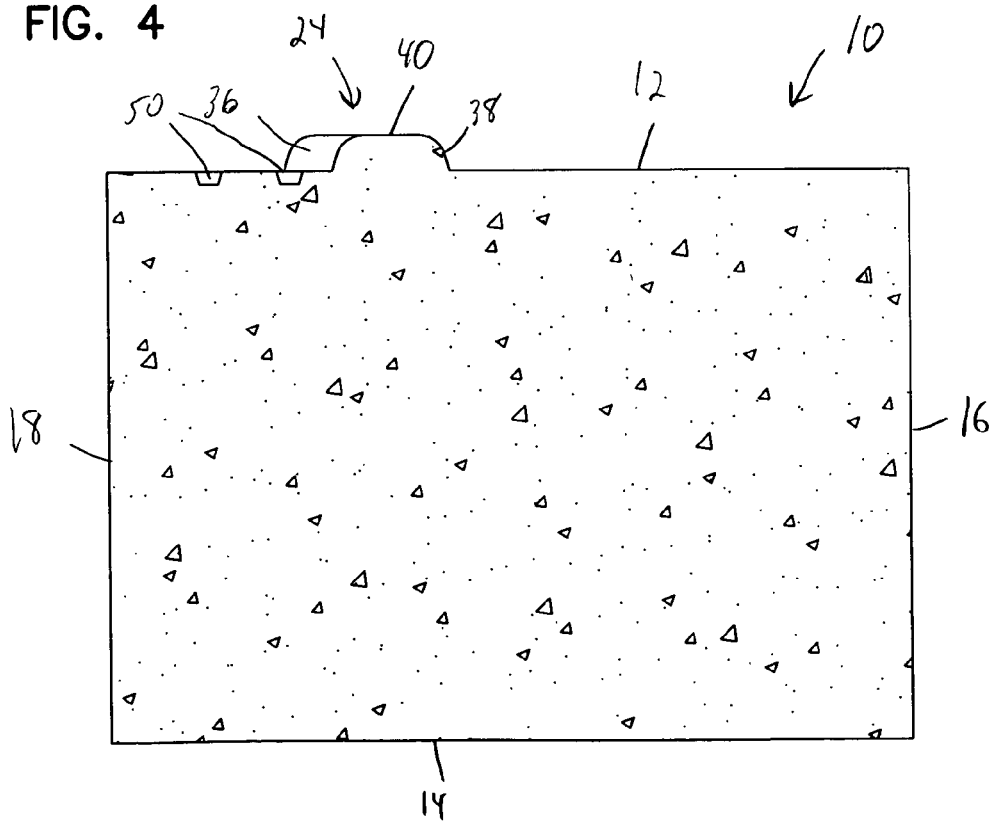
FIG. 4 is a cross-sectional view of the block taken along line 4—4 of FIG. 3.

Turning now to FIGS. 2–4, a concrete retaining wall block 10 is illustrated. The block 10 is configured as a Vertica® style block. Details on the configuration and formation of this type of block can be found in U.S. Pat. No. 5,795,105, which is incorporated herein by reference in its entirety.

The block 10 comprises a block body having a top surface 12, a bottom surface 14, a front surface 16, a rear surface 18, a first side surface 20 and a second side surface 22. The block 10 also includes a locator 24 integrally formed on the top surface 12, and insets 26A, 26B. The block 10 could also be provided with a core (not shown) in order to reduce the weight of the block and reduce the material needed to produce the block.

The block 10 is formed of low slump concrete and is molded in a suitably configured mold. Details of the mold and molding process are disclosed in U.S. Pat. No. 5,795,105.

The top and bottom surfaces 12, 14 are preferably configured so that when a plurality of like blocks are stacked on top of one another into courses to form a wall, the blocks in each upper course of blocks rest flat on top of the blocks in each lower course of blocks. In the illustrated embodiment, the top surface 12 is generally planar except for presence of the locator 24 and the later described indentation(s) that forms a means for indicating batter. The bottom surface 14 is also generally planar.

The front surface 16 extends generally vertically between the top and bottom surfaces 12, 14 and extends from one side surface 20 to the other side surface 22. The front surface 16, which is visible when laid up in a wall, is preferably formed with a rough or "rock" face that results from a splitting process. The front surface 16 is illustrated as being a single panel between the side surfaces 20, 22. However, the front surface 16 can take on many configurations, for example multi-faceted and curved.

The rear surface 18 also extends generally vertically between the top and bottom surfaces 12, 14 and extends from one side surface 20 to the other side surface 22. In the illustrated embodiment, the rear surface 18 extends generally linearly from side surface 20 to side surface 22.

The side surfaces 20, 22 extend generally vertically between the top and bottom surfaces 12, 14 and extend from the front surface 16 to the rear surface 18. In the illustrated embodiment, the side surfaces 20, 22 are each composed of two sections 30, 32, with section 30 being a forward section that intersects the front surface 16 and section 32 being a rearward section that intersects the rear surface 18, separated by the surfaces that form the insets 26A, 26B. The side surfaces 20, 22 generally converge toward the rear of the block to provide the block 10 with a taper so that the width of the front surface 16 is greater than the width of the rear surface 18. This permits the construction of serpentine walls, including inside and outside curves, using the blocks 10.

The block 10 also has one or more generally forward-facing locking surfaces 34 and one or more generally rearward-facing locking surfaces 36. The locking surfaces 34, 36 are preferably configured and positioned on the block such that when a retaining wall is constructed of a multiplicity of the blocks in multiple courses, the locking surfaces of blocks in adjacent courses are able to engage with one another to provide the setback as illustrated in FIG. 1, thereby establishing the batter.

In the embodiment illustrated in FIGS. 2–4, the forward-facing locking surfaces 34 are formed as part of the insets 26A, 26B, while the rearward-facing locking surfaces 36 are part of the locator 24 on the top surface of the block. An inset 26A, 26B of a block in an upper course of blocks is sized to receive at least a portion of the locator 24 of a block in a lower course with enough play to permit the block in the upper course to be slid forward until the forward-facing locking surface 34 of one of the insets 26A, 26B abuts against one of the rearward-facing locking surfaces 36 of the locator 24 to establish the setback.

As shown in FIGS. 2–4, the locator 24 is a protrusion that is integrally formed on the top surface 12 of the block and projects upwardly from the top surface. The protrusion has an angled perimeter surface 38 extending around the entire perimeter thereof and a top surface 40. A portion of the perimeter surface 38 includes the rearward-facing locking surfaces 36. The angle of the perimeter surface 38 facilitates release of the protrusion from the corresponding mold surface used to mold the protrusion.

The locator 24 and the rearward-facing locking surfaces 36 included therewith can take many configurations. As shown in FIG. 3, it is preferred that the locator 24 have a configuration whereby the locking surfaces 36 are curved in top plan view. The curvature of the locking surfaces 36 facilitates rotation of the block in the upper course relative to the block in the lower course when creating a curved wall, while maintaining contact between the locking surfaces. The locator 24 in FIG. 3 has a curved locking surface 36 at each end, where one locking surface 36 will engage with a locking surface 34 on one block in an upper course, and the other locking surface 36 will engage with a locking surface 34 on a second block in the upper course.

The locator 24 is illustrated in FIG. 3 as having a "dog-bone" shape with a reduced intermediate portion between the ends. However, the locator 24 could be formed as separate protrusions, each of which defines a locking surface 36.

As discussed above, each inset 26A, 26B defines a forward-facing locking surface 34. Each inset also includes a generally rearward facing surface 42 and a surface 44 interconnecting the surfaces 34, 42. The insets 26A, 26B are illustrated as extending from the top surface 12 to the bottom surface 14.

When blocks of the type shown in FIGS. 2–4 are stacked into courses to form a wall, and the locking surfaces are engaged, each upper course is setback from each lower course to establish the batter of the wall. A change in the relative positions of the forward-facing locking surface and the rearward-facing locking surface changes the course-to-course setback, with a resulting change in the batter. However, it can be difficult to look at a block and the relative positions of the forward-facing locking surface and the rearward-facing locking surface and determine therefrom what the resulting batter will be.

The block 10 in FIGS. 2–4 is provided with means for indicating the degree of batter that will result from constructing a retaining wall of a multiplicity of the blocks 10. The means for indicating the batter is integrally formed with the block 10. Preferably, the means for indicating the batter comprises one or more indentations 50 formed in a surface of the block other than the front surface 16. Because the front surface 16 has a split face, and because the front surface 16 is visible in the wall, the front surface 16 is not a desirable location for the indentation(s).

In the illustrated embodiment, a plurality of indentations 50 are formed in the top surface 12 of the block 10 behind the locator 24. Each indentation 50 indicates a degree of batter that will result. For example, four indentations 50 are illustrated thereby indicating a batter of 4 degrees. If the block were configured so that the resulting batter was 2 degrees, two indentations would be used. Preferably, the locations of the indentations are different for different batters, i.e. the indentations are in different patterns, so that if one indentation is obliterated the user can still tell what batter is intended to be.

Figure 6:
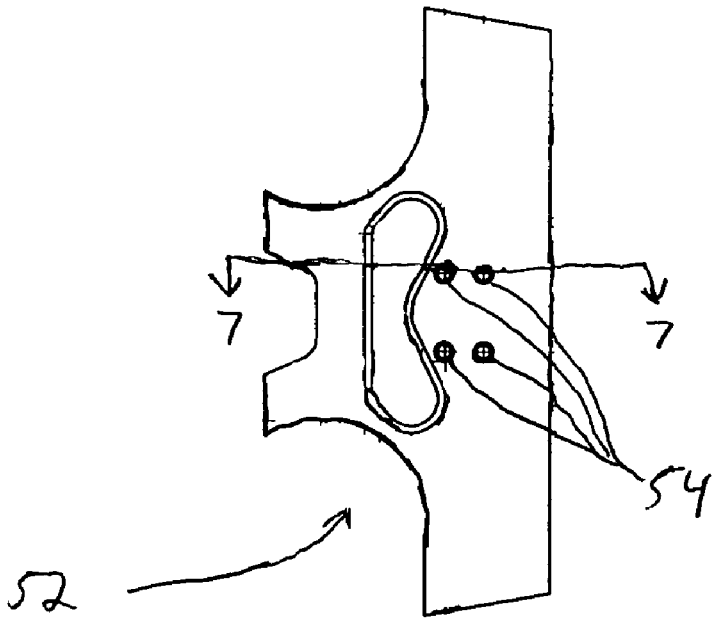
FIG. 6 is a bottom plan view of a portion of a stripper shoe used to create the indentations illustrated in FIG. 2.
Figure 7:
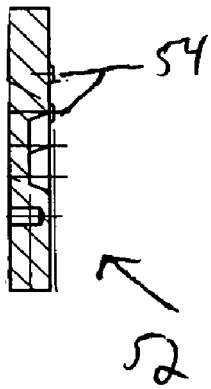
FIG. 7 is a side view of the stripper shoe taken along line 7—7 of FIG. 6.

Formation of indentations 50 in the top surface 12 is achieved using a stripper shoe 52, illustrated in FIGS. 6 and 7, which presses into the top of the block body during the molding process and strips the block from the mold. The shoe 52 is provided with projections 54 that correspond to the indentations to be formed and that create the indentations in the top of the block during molding. The stripper shoe is also formed to create the locator 24 on the top of the block. Thus, the location of the locator 24 and the number of projections 54 on a stripper shoe correspond to the desired batter, and a different batter can be achieved simply by changing the stripper shoe.

The indentations 50 are spaced apart a sufficient distance that formation of one indentation during molding does not obscure another indentation. With the indentations illustrated in FIG. 3, a sufficient spacing has been found to be about 1.0 inch between indentations front-to-back, and about 2.0 inch between indentations side-to-side.

The indentation(s) can take a variety of forms, including the indentations 50 shown in FIG. 3, each one of which indicates one degree of batter that will result, or an indentation in the form of a numeral, for example a Roman numeral, with the numeral indicating the degree of batter. The indentations 50 have a generally circular shape in top plan view with tapered sides in side plan view. Each indentation 50 has the following dimensions: 0.5 inch diameter at the surface of the block; 0.125 inch depth; 30 degree sidewall angle from vertical.

Figure 5:
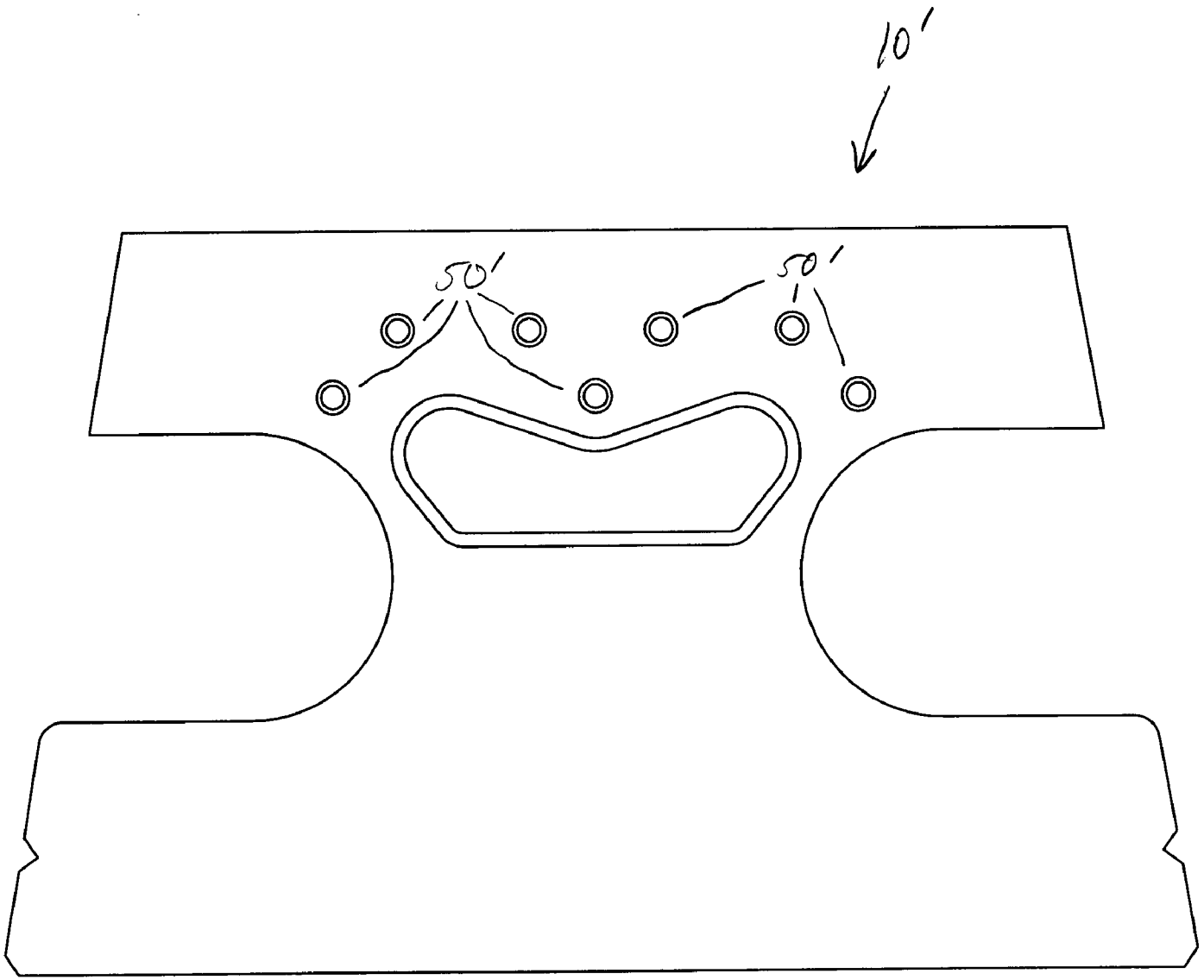
FIG. 5 is a top plan view of a second embodiment of a retaining wall block having indentations on the top surface to indicate the degree of batter.

FIG. 5 illustrates an embodiment of a block 10' having seven indentations 50' on the top surface thereof to indicate a batter of seven degrees. The pattern of the indentations 50' on the top surface of the block 10' is different than the pattern of the indentations 50 on the block 10, which aids in distinguishing the intended batter in the event that some of the indentations are obliterated or obscured. Likewise, it is preferable, for other batters, for the indentations to be in a distinctive pattern to aid in identifying the correct batter.

Although the indentations have been described as being formed behind the locator 24, the indentations could be positioned at any suitable location on the top surface of the block, as well as on another block surface other than the front surface as discussed above.

Regardless of the form of indentation(s) that is used, the indentation(s) should have a relatively simple shape to facilitate release of the stripper shoe 52 from the concrete during molding. If the shoe does not adequately release from the concrete, the indentation(s) may not adequately form. The generally circular indentations with tapered sides illustrated in FIGS. 2–5 have been found to achieve satisfactory release of the shoe during molding.

The use of one or more indentations provides a visual indication to a user as to what the resulting batter will be. As a result, there is less chance of using incorrectly configured blocks having batters that differ from the desired batter. Further, the indentations do not interfere with the proper functioning of the block. As shown in FIG. 1, when a plurality of the blocks are stacked into courses and the locking surfaces are engaged, the blocks in each upper course are setback from the blocks in each lower course, and the wall has a resulting batter $\alpha$ that is equal to the batter indicated by the indentations.

The above specification, examples and data provide a complete description of the manufacture and use of the retaining wall block with the batter indicating means. Since many embodiments of the retaining wall block can be made without departing from the spirit and scope of the invention, the invention resides in the claims hereinafter appended.

What is claimed is:

1. A mortarless retaining wall block comprising:

a block body having a top, a bottom, a front surface, a rear surface, and first and second sides; the block body having a generally forward-facing locking surface formed integrally with the bottom thereof and a generally rearward-facing locking surface formed integrally with the top thereof such that when a retaining wall is constructed of a multiplicity of the blocks in multiple courses, the forward-facing locking surface of a block in one course of the blocks engages the rearward-facing locking surface of a block in the course of blocks below it to establish the batter of the wall; and one or more indentations formed in a surface of the block body, other than the front surface, which indicate the degree of batter that results in constructing a retaining wall of a multiplicity of the blocks.

2. The mortarless retaining wall block of claim 1 wherein there is one indentation for each degree of batter that results in constructing a retaining wall of a multiplicity of the blocks.

3. The mortarless retaining wall block of claim 1 wherein the indentations are formed in the top of the block body.

4. The mortarless retaining wall block of claim 1 wherein the generally rearward-facing locking surface is formed on the top surface of the block body and is positioned thereon in a position that determines the batter of the wall constructed from a multiplicity of the blocks.

5. The mortarless retaining wall block of claim 1 wherein the indentations are in a pattern that indicates the degree of batter that results in constructing a retaining wall of a multiplicity of the blocks.

6. The mortarless retaining wall block of claim 1 wherein the indentations are circular in cross-section.

7. The mortarless retaining wall block of claim 1 wherein the indentations are spaced apart a sufficient distance that formation of an indentation in the molding of the block does not obscure another indentation.

8. The mortarless retaining wall block of claim 1 wherein the block is made of dry cast concrete and the indentations are formed by a stripper shoe which presses into the top of the block body and strips the block from a mold.

9. A mortarless retaining wall block comprising:

a block body having a top, a bottom, a front, a rear, and first and second sides;

the block body having a generally forward-facing locking surface and a generally rearward-facing locking surface configured and positioned such that when a retaining wall is constructed of a multiplicity of the blocks in multiple courses, engagement between the forward-facing locking surface of a block in one course of blocks and the rearward-facing locking surface of a block in an adjacent course of blocks establishes the batter of the wall; and one or more indentations formed in a surface of the block body which indicate the degree of batter that results in constructing a retaining wall of a multiplicity of the blocks.

10. The mortarless retaining wall block of claim 9 wherein the indentations are formed in a surface of the block other than the front of the block body.

11. The mortarless retaining wall block of claim 9 wherein there is one indentation for each degree of batter that results in constructing a retaining wall of a multiplicity of the blocks.

12. The mortarless retaining wall block of claim 9 wherein the indentations are formed in the top of the block body.

13. The mortarless retaining wall block of claim 12 wherein the generally rearward-facing locking surface is formed on the top surface of the block body and is positioned thereon in a position that determines the batter of the wall constructed from a multiplicity of the blocks.

14. The mortarless retaining wall block of claim 9 wherein the indentations are in a pattern that indicates the degree of batter that results in constructing a retaining wall of a multiplicity of the blocks.

15. The mortarless retaining wall block of claim 9 wherein the indentations are circular in cross-section.

16. The mortarless retaining wall block of claim 9 wherein the indentations are spaced apart a sufficient distance that formation of an indentation in the molding of the block does not obscure another indentation.

17. The mortarless retaining wall block of claim 9 wherein the block is made of dry cast concrete and the indentations are formed by a stripper shoe which presses into the top of the block body and strips the block from a mold.

18. A mortarless retaining wall block comprising:

a block body having a top, a bottom, a front, a rear, and first and second side;

means on the block body for defining a generally forward-facing locking surface and means on the block body for defining a generally rearward-facing locking surface such that when a retaining wall is constructed of a multiplicity of the blocks in multiple courses, engagement between the forward-facing locking surface of a block body and the rearward-facing locking surface of a block body in an adjacent course of blocks establishes the batter of the wall; and means for indicating the degree of batter that results in constructing a retaining wall of a multiplicity of the blocks, the means for indicating being integrally formed with the block body.

19. The mortarless retaining wall block of claim 18, wherein the means for indicating comprises at least one indentation formed in the block body.

20. The mortarless retaining wall block of claim 19, comprising a plurality of indentations formed in the top of the block body.

21. The mortarless retaining wall block of claim 20 wherein the indentations are in a pattern that indicates the degree of batter that results in constructing a retaining wall of a multiplicity of the blocks.

22. The mortarless retaining wall block of claim 20 wherein the indentations are circular in cross-section.

23. The mortarless retaining wall block of claim 20 wherein the indentations are spaced apart a sufficient distance that formation of an indentation in the molding of the block does not obscure another indentation.

24. The mortarless retaining wall block of claim 20 wherein the block is made of dry cast concrete and the indentations are formed by a stripper shoe which presses into the top of the block body and strips the block from a mold.

25. The mortarless retaining wall block of claim 19 wherein there is one indentation for each degree of batter that results in constructing a retaining wall of a multiplicity of the blocks.

26. The mortarless retaining wall block of claim 18 wherein the means for indicating is formed in a surface of the block other than the front surface.

27. The mortarless retaining wall block of claim 18 wherein the means for defining a generally forward-facing locking surface comprises an inset formed in the block body, and the means for defining a generally rearward-facing locking surface comprises a protrusion integrally formed on the block body.

28. The mortarless retaining wall block of claim 18 wherein the generally rearward-facing locking surface is formed on the top surface of the block body and is positioned thereon in a position that determines the batter of the wall constructed from a multiplicity of the blocks.

* * * * *